United States Patent [19]

Kachkarov et al.

[11] 4,198,995

[45] Apr. 22, 1980

[54] APPARATUS FOR ELECTROHYDROBLASTING OF CASTINGS

[75] Inventors: Alexandr G. Kachkarov; Sergei B. Rozhansky; Valentina A. Golovakhina; Valery V. Prikhodko, all of Nikolaev, U.S.S.R.

[73] Assignee: Proektno-Konstruktorskoe Bjuro Elektrogidravliki Akademii Nauk Ukrainskoi SSR, Nikolaev, U.S.S.R.

[21] Appl. No.: 25,006

[22] Filed: Mar. 29, 1979

[51] Int. Cl.[2] ..... B08B 3/10

[52] U.S. Cl. ..... 134/133; 134/165; 134/184; 366/127

[58] Field of Search ..... 134/1, 83, 133, 164–165, 134/184; 366/127

[56] References Cited

U.S. PATENT DOCUMENTS

| | | | |
|---|---|---|---|
| 2,349,679 | 5/1944 | Roth | 134/164 X |
| 2,859,029 | 11/1958 | Joy | 134/83 |
| 3,083,716 | 4/1963 | Rowan et al. | 134/133 X |
| 3,429,743 | 2/1969 | Branson | 366/127 X |
| 3,476,126 | 11/1969 | Pinkham | 134/133 X |
| 3,957,252 | 5/1976 | Storz | 134/184 X |
| 3,989,537 | 11/1976 | Sickmeier | 134/1 |

FOREIGN PATENT DOCUMENTS

| | | | |
|---|---|---|---|
| 1303223 | 1/1973 | United Kingdom | 134/184 |

*Primary Examiner*—Robert L. Bleutge
*Attorney, Agent, or Firm*—Fleit & Jacobson

[57] ABSTRACT

An apparatus for electrohydroblasting of castings comprises a base, a bath, a mechanism for feeding castings into the bath, having a movable platform mounted in vertical guides, and a loading device. The loading device comprises horizontal guides and a means for conveying castings along the horizontal guides. The horizontal guides have a section disposed above the bath and sections mounted on the base. In accordance with the invention, the section of the horizontal guides, disposed above the bath, is mounted on the movable platform of the mechanism for feeding castings into the bath.

9 Claims, 14 Drawing Figures

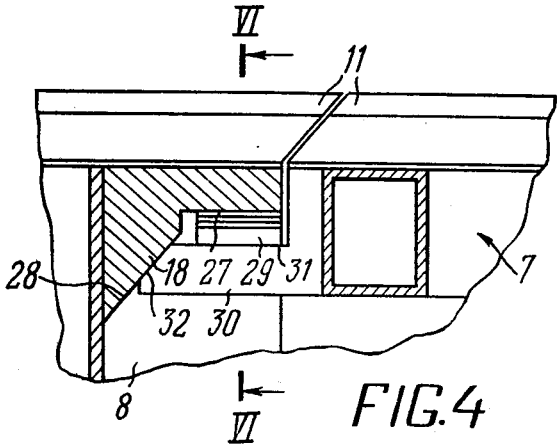
FIG.4
FIG.6
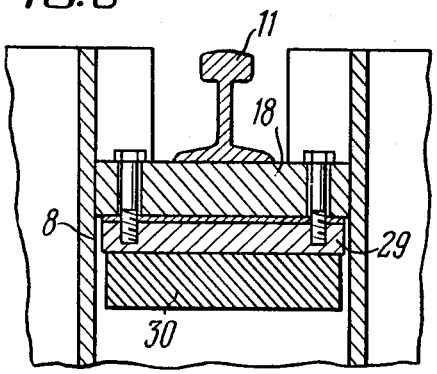

69
68
70
80
69
68
71
76
74
73
79
4
5

APPARATUS FOR ELECTROHYDROBLASTING OF CASTINGS

BACKGROUND OF THE INVENTION

1. Field of the Invention

The present invention relates to foundry practice and is specifically concerned with apparatus for cleaning castings of core and moulding sands, whose operation is based on an electrohydraulic effect.

The term "electrohydraulic effect" as used here and hereinbelow refers to the action exerted upon a solid body by pulse pressures generated by a high-voltage discharge in a liquid.

Accordingly, the term "electrohydroblasting" of castings denotes the breaking down of layers of core and moulding sands stuck to the surface of a casting by means of pulse discharges generated across an electrode and the casting, which are placed into a liquid, i.e. by means of an electrohydraulic effect.

The proposed electrohydroblasting apparatus is basically intended to process large castings and can be used preferably at enterprises with a piece and lot production, but in some instances, at ones with a large-lot production of castings.

The term "large casting" refers here and hereafter to castings of 100 kg to 40,000 kg and over.

2. Description of the Prior Art

Among the means intended to clean castings (especially large ones), the electrohydroblasting apparatus are distinguished by a high productivity, economic efficiency, ability to clean effectively complex-shaped castings and improved conditions of work. However, the problem of cleaning castings with the use of these apparatus remains as yet to be adequately solved.

The majority of apparatus for electrohydroblasting of castings is adapted for mass-production flow lines. Such apparatus are essentially similar in construction and comprise a bath with a liquid, a cluster of electrodes set against characteristic points of a casting, an electrode positioning mechanism and a handling means serving to remove a casting from a feeding conveyor and to feed the casting into the bath as is disclosed in U. K. Pat. No. 1,303,223.

As regards large castings, however, it is well known that no mass production thereof is required industrially, and such castings are produced either in single pieces or in small lots.

It is apparent that the electrohydroblasting apparatus of the above type are unfit for cleaning single-piece large castings, since this will necessitate re-arranging the electrode clusters and re-designing the handling means for each individual casting or lot of castings, which is labor-consuming and unjustifiably lengthens the time spent to prepare the apparatus for work.

Much more suitable for use in piece and small-lot production of large castings is an apparatus for electroblasting of castings disclosed in the USSR Inventor's Certificate No. 415,091.

This apparatus comprises a base, a bath with a liquid, mounted on the base and an electrode fixed in a means for introduction of said electrode into the bath and electrically connected to a pulse-current generator. The apparatus also comprises a means for feeding castings into the bath with a liquid, which means includes a movable platform mounted in vertical guides installed at the sides of the bath and a drive coupled with said platform through flexible pull members; said drive is a winch coupled with the platform through a cable-and-pulley system. The apparatus further comprises a loading device which includes horizontal guides consisting of a section mounted on the base and of a section mounted above the bath, and a self-propelled carriage for conveying containers with a casting (or castings) along the horizontal guides from the loading point to the section disposed above the bath and conveying them back to the unloading point. The self-propelled carriage is a three-component frame mounted on rollers and comprising two lengthwise, or side, girders each arranged along one of the guides, strictly thereabove, and only one cross girder interconnecting the ends of the side girders. The frame is of a U-shaped configuration in plan and installed so that its aperture faces the bath. The frame cross girder carries an electric drive of the rollers which move the frame along the guides. A container with a casting (or castings) is placed onto the carriage at the loading/unloading station, disposed on the guide section mounted on the base, so that its front portion bears on the side girders, and its rear portion, on the cross girder, for which purpose the container incorporates brackets with pins, recesses for said pins being provided on the carriage frame, one recess on each of the non-braced ends of the side girders and two recesses on the cross girder. Such an arrangement of the supporting members prevents twisting of the carriage side girders under the weight of the container with a casting (or castings). After the container has been placed onto the carriage, said carriage is moved along the horizontal guides to the extreme position on the section mounted above the bath in a manner to situate the points where the container rests upon the side girders beyond the end face of the horizontal guides, as otherwise the brackets with pins in the front portion of the container will rub against the horizontal guides during the subsequent lowering of said container on the platform. As the carriage reaches said position, the means for feeding castings into the bath is set into operation; the platform of the means moving underneath the carriage and lifting the container off the carriage by rests provided for this purpose on the platform. The carriage then travels back to allow thereby an unhindered lowering of the platform with the container into the bath. After the electrohydroblasting of the casting has been accomplished, the container with the casting (or castings) is by means of the platform and the carriage returned in the reverse order to the loading/unloading station.

Thus the time T of one cycle of the apparatus operation consists of the following periods:

$t_1$ = loading time;

$t_2$ = time for conveying the container from the loading/unloading station to the position for immersing it into the bath;

$t_3$ = time for immersing the container into the bath;

$t_4$ = processing time;

$t_5$ = time for withdrawing the container out of the bath;

$t_6$ = time for conveying the container back to the loading/unloading station;

$t_7$ = time for unloading the carriage.

Hence, $T=t_1+t_2+t_3+t_4+t_5+t_6t_7$, of which only $t_4$ can be classed with productive time $T_p$, whereas the rest of the periods fall into the unproductive or handling time $$T_h=(T-T_p)=(T_1+t_2+t_3+t_4+t_5+t_6+t_7)-t_4=t_1+t_2+t_3+t_5+t_6+t_7.$$

It is clear from the above that the productivity of the apparatus can be enhanced by shortening the processing cycle time, e.g. by reducing the handling time $T_h$. A means to this end is to accomplish the loading/unloading operations concurrently with the processing of castings, but this is made impossible by the coincidence in space of the loading and the unloading stations, which are disposed on the guides on the same side of the bath. A next conveyor cannot thus be delivered for processing until the carriage is unloaded. On the other hand, it proves impossible to locate the loading and unloading stations on the opposite sides of the bath and to enable thereby the next container to be loaded onto the carriage while the preceding container is in the bath and the former container to be conveyed from the loading station to the bath as the latter container is transported from the bath to the unloading station because, of necessity, the guides of the apparatus are ended above the bath to permit containers to be lowered into the bath with a liquid.

Moreover, the loading device guides limit the width of the castings to be processed as those whose width exceeds the spacing (gauge) of the guides cannot pass into the bath; this narrows the processing potentialities of the apparatus (the range of products being processed).

It is an aim of the invention to provide an apparatus for electrohydroblasting of castings with loading and unloading stations located apart ensuring a higher efficiency due to a reduction in processing time obtained by performing processing and handling operations parallelly.

SUMMARY OF THE INVENTION

Another object of the invention is to provide an apparatus for electrohydroblasting of castings expanding the processing potentialities of the apparatus.

The above-mentioned and other objects of the invention are attained in an apparatus for electrohydroblasting of castings, comprising a base, a bath mounted on the base, a means for feeding castings into the bath, which means has a movable platform mounted in vertical guides installed at the sides of the bath and a drive coupled with said platform through flexible pull members, a loading device comprising horizontal guides which are in part disposed on said base and have a section disposed above the bath, and a means for conveying castings along the horizontal guides; an electrode and a device for introducing said electrode into the bath, which device is mounted adjacent the bath; and a pulse-current generator electrically connected with the electrode, according to the invention, the section of the horizontal guides of the loading device, disposed above the bath, is placed apart from the horizontal guides mounted on the base on the movable platform of the means for feeding castings into the bath, which means is provided with platform misalignment compensators through which the flexible pull members are connected with the drive of said means for feeding castings into the bath, the horizontal guides, mounted on the base, having sections disposed at both sides of the bath for bringing them into abutting relation on both sides with the guides disposed on the movable platform, and the means for conveying castings along said horizontal guides of the loading device being operatively interlocked with the means for feeding castings into the bath.

Such arrangement of the apparatus for electrohydroblasting of castings allows the loading and the unloading stations to be located apart from each other on different sides of the processing station so that, when the platform of the means for feeding castings into the bath is in the uppermost position, the guide section attached to the platform is brought into abutting, or end-to-end relation with the sections disposed on the base both upstream and downstream of the processing station, ensuring thereby a "through" path for the container with a casting (or castings). Hence, after processing has been accomplished and the container has been lifted out of the bath, the container is conveyed in the same direction, as that of its previous conveyance over the "loading station-to-platform" section of the horizontal guides, to the opposite section of the guides where the unloading station is disposed, rather than in the reverse direction as in the prior art apparatus. This enables the auxiliary operations of loading/unloading and in part also of conveying the castings to the processing station to be performed concurrently with the processing of a casting, which shortens the working cycle of the apparatus and thereby raises its productivity.

Moreover, owing to the fact that the guide section disposed above the bath is attached to the movable platform of the means for feeding castings into the bath and is movable jointly with the platform, there are no obstacles to loading castings of essentially any width into the bath, this widening processing potentialities of the apparatus.

For the apparatus to be capable of operating in the above-described manner, it is essential that the horizontal guide section mounted on the platform be brought into exact abutting relation with the horizontal guide sections disposed on the base. This is provided by the construction of the means for feeding castings into the bath, which means incorporates the misalignment compensators of said platform.

The operating capability of the apparatus is further ensured by that the means for conveying castings along the horizontal guides is operatively interlocked with the means for feeding castings into the bath. Without such an interlock, the former of said means could have fed a container with a casting (castings) onto the platform when the movable (on the platform) and fixed sections of the horizontal guides have not yet been brought into abutting relation, which would certainly result in a breakdown.

The means for feeding castings into the bath in the apparatus for electrohydroblasting of castings is preferably provided with locators defining the uppermost position of the movable platform, installed on the vertical guides wherein said platform is mounted. This greatly simplifies bringing the horizontal guide section disposed on the platform into abutting relation with the horizontal guide sections disposed on the base.

It is further expedient that said locators of the uppermost position of the platform be in the form of stops each having a horizontal and an inclined contact flats, and the platform also be provided with horizontal and inclined contact flats corresponding to respective contact flats of the stops, this enhancing the accuracy of the uppermost positioning of the platform.

The horizontal contact flats of said stop should be preferably provided with pads secured thereto. This to compensate for errors of location of the movable platform in the uppermost position, which may result, for example, from wear of the surfaces of the contact flats.

The compensators of misalignment of the platform of the means for feeding castings into the bath in the apparatus for electrohydroblasting of castings are expediently made in the form of crossbeams mounted in twin guides, the ends of the crossbeams being coupled with the flexible pull members and the crossbeams themselves being connected to the drive by members which allow the crossbeams to swing, the sections of the twin guides corresponding to the extreme position of the crossbeams in lifting the movable platform having recesses to provide a clearance between the ends of the crossbeams and the twin guides.

Such a construction ensures the compensation for a misalignment of the platform in its uppermost position arising from unequal lengths of the flexible pull members tending to stretch under the action of forces applied thereto. If the lengths of the pull members attached to the ends of a crossbeam are unequal, then, as the crossbeam reaches the extreme position, the shorter pull member tightens and thereby prevents a further movement of the crossbeam end whereto it is coupled, the cross-beam then being caused to twin by the action of the drive whereto it is slewably coupled, the centre of the turn being the point where the crossbeam is attached to the shorter pull member, and the radius of the turn, the distance from the end coupled with the shorter pull member to the end coupled with the longer pull member. The above-described action results in the tightening of the longer pull member. The turning of the crossbeam in the guides is made possible by a clearance between the ends of the crossbeam and the bottoms of the recesses provided in the twin guides.

The size $\Delta 1$ of the clearance between the ends of the crossbeams and the twin guides should preferably be equal to:

$$\Delta 1 = a \sin \alpha - 2b \sin^2(\alpha/2),$$

where a is the distance between the extreme points of support of one end of the crossbeam, b is the distance between the ends of the crossbeam, and $\alpha$ is the permissible crossbeam turning angle which sould not exceed 10 degrees of arc.

The drive of the means for feeding castings into the bath with a liquid in the apparatus for electrohydroblasting of castings is preferably a hydraulic system comprising hydraulic cylinders whose rods are hinge-connected with the crossbeams of the platform misalignment compensators, the hydraulic cylinders being provided with a system for synchronizing the movement of their rods, which system comprises hydraulic motors through which hydraulic fluid is fed to and drained from the hydraulic cylinders and by-pass valves interconnecting the hydraulic cylinder chambers communicating with the hydraulic motors whose rotors are fixedly coupled with each other.

Such a construction of the apparatus for electrohydroblasting of castings ensures a reliable abutment of the sections of the horizontal guides on operation of the means for feeding castings into the bath, even when the load is irregularly arranged on the platform.

The sections of the horizontal guides of the loading device, disposed on the base of the apparatus for electrohydroblasting of castings, may be rectilinear and the means for conveying castings therealong may have the form of chain conveyors with grips, disposed on each of said sections of the guides.

Such a modification of the apparatus for electrohydroblasting of castings enables the containers with castings to be conveyed directly on the guides, which simplifies both the construction of the apparatus and the loading and the withdrawal of castings from the processing apparatus, since it obviates the need for self-propelled carriages.

Alternatively, the horizontal guides of the loading device in the apparatus for electrohydroblasting of castings may be curvilinear and ring-shaped in plan and the means for conveying castings along said guides may have the form of a rotor with grips.

Such an alternative is a simplest and a most convenient means for automating the operation of the apparatus.

BRIEF DESCRIPTION OF THE DRAWINGS

The invention will now be explained by a description of embodiments thereof with reference to the accompanying drawings, wherein:

FIG. 4 is a sectional view taken along the line IV—IV in FIG. 2 and showing a part of the means for feeding castings into the bath;

FIG. 6 is a sectional view taken along the lines VI—VI in FIG. 4;

Referring to FIG. 1, the apparatus for electrohydroblasting of castings comprises a base 1 whereon a bath 2 with a funnel-shaped bottom portion 3 is installed.

Figure 1:
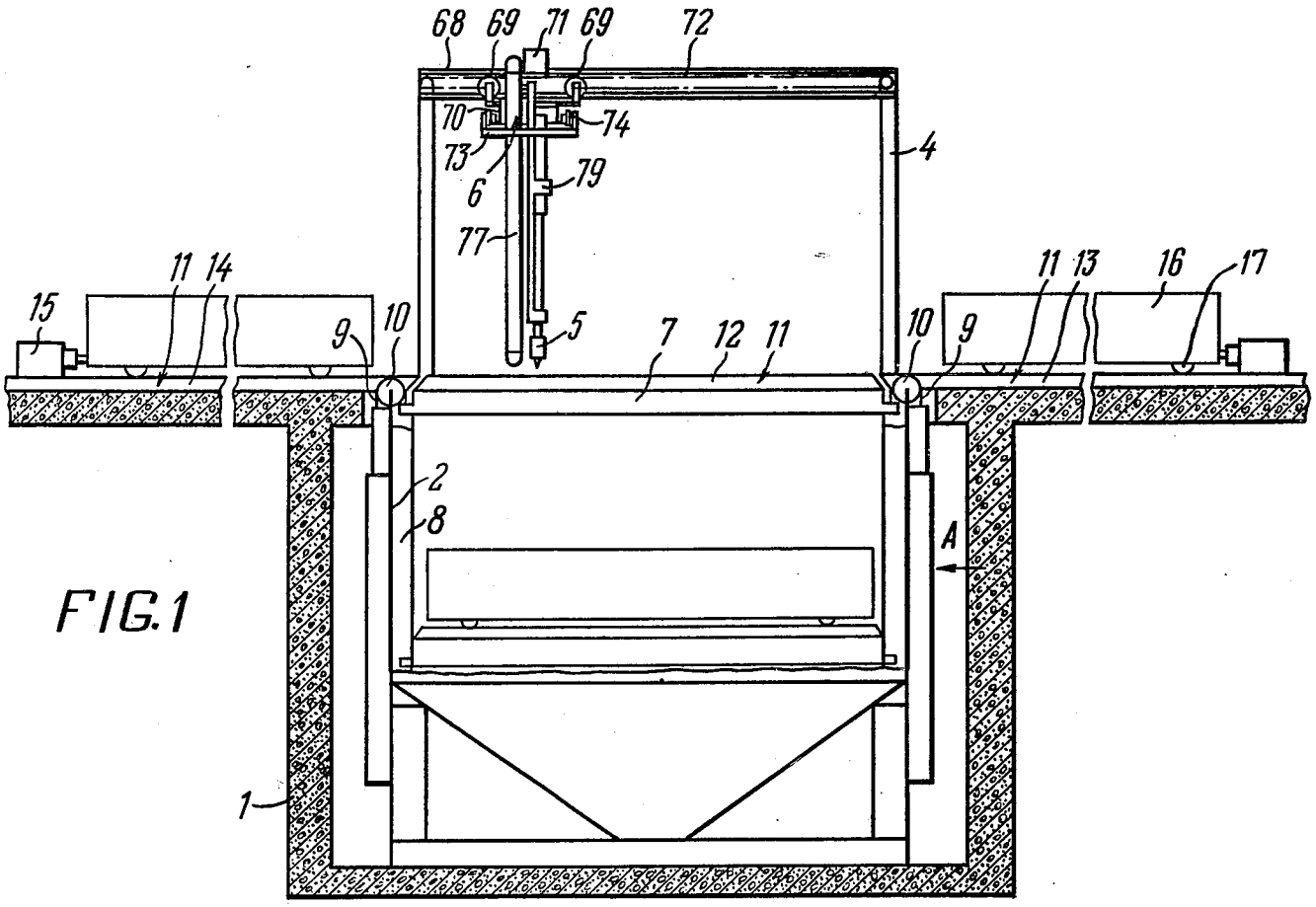
FIG. 1 is a diagrammatic view of the apparatus for electrohydroblasting of castings according to the invention.

A gantry 4 carrying an electrode unit which includes an electrode 5 and a device 6 for introducing the electrode into the bath is mounted above the bath.

The apparatus for electrohydroblasting of castings comprises also a means for feeding castings into the bath, which means includes a movable platform 7 mounted in vertical guides 8 installed on the sides of the bath 2 and a drive coupled with the movable platform 7 through flexible pull members 9 passed around pulleys 10.

The apparatus for electrohydroblasting of castings also comprises a loading device which includes horizontal guides 11 having a section 12 disposed above the bath 2 and sections 13 and 14 disposed on both sides of the bath; the sections 13 and 14 of the horizontal guides 11 are mounted on the base 1, whereas the section 12 thereof is separated from the sections 13 and 14 and is mounted on the movable platform 7 of the means for feeding castings into the bath in order to bring the ends of the horizontal guides of the section 12 into abutting relation with the ends of the horizontal guides of the sections 13 and 14.

The loading device further comprises a means 15 for conveying castings along the horizontal guides 11. Castings are conveyed in latticed containers 16 fitted with rollers 17.

Figure 2:
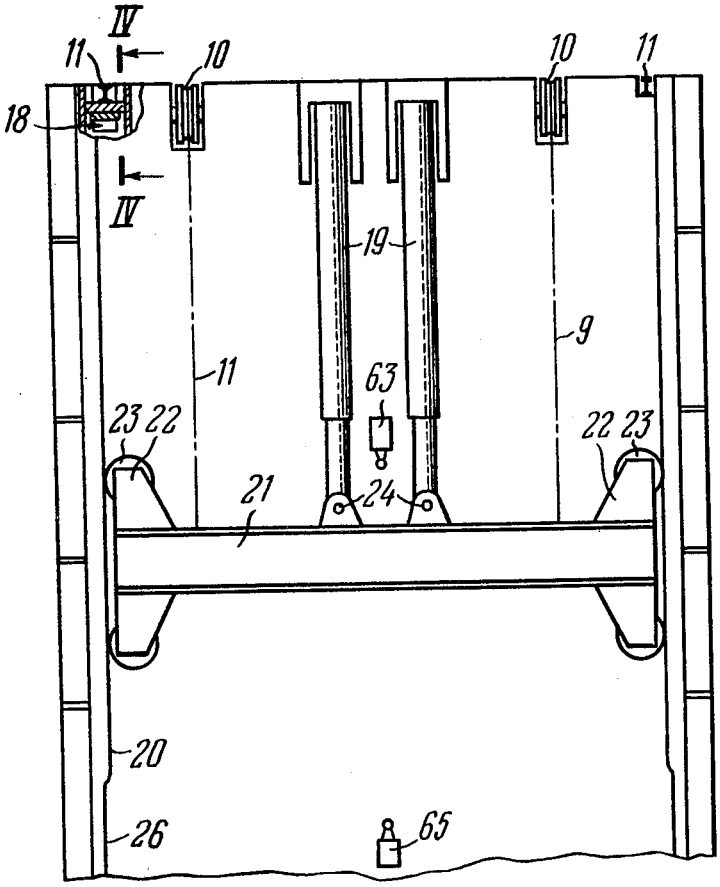
FIG. 2 is a view in the direction of arrow A in FIG. 1, diagrammatically illustrating the means for feeding castings into the bath of the apparatus for electrohydroblasting of castings according to the invention.

Referring now to FIG. 2, the means for feeding castings into the bath comprises locators 18 of the uppermosr position of the movable platform 7, installed on the vertical guides 8 and described in detail hereinafter. Said means comprises also platform misalignment compensators through which the flexible pull members 9 are coupled with the drive which is a hydraulic system including hydraulic cylinders 19. Each of the platform misalignment compensators is a crossbeam 21 mounted in twin guides 20 and having at its ends brackets 22 carrying supporting rollers 23 through which the crossbeam 21 bears against the twin guides 20. Said crossbeam 21 is through hinge joints 24 attached to rods 25 of a pair of the hydraulic cylinders 19, the hinge joints 24 enabling the crossbeam to swing with respect to the rods 25 of the hydraulic cylinders 19. (It iwll be understood that the number of the hydraulic cylinders 19 acting on the crossbeam 21 depends upon the magnitude of the force to be applied to the pull members 9). The sections of the twin guides 20, corresponding to the extreme position of the crossbeam 21 in lifting the movable platform 7, have recesses, a clearance being provided between the bottom 26 of each of the recesses and the ends of the twin guides (FIG. 3).

Figure 3:
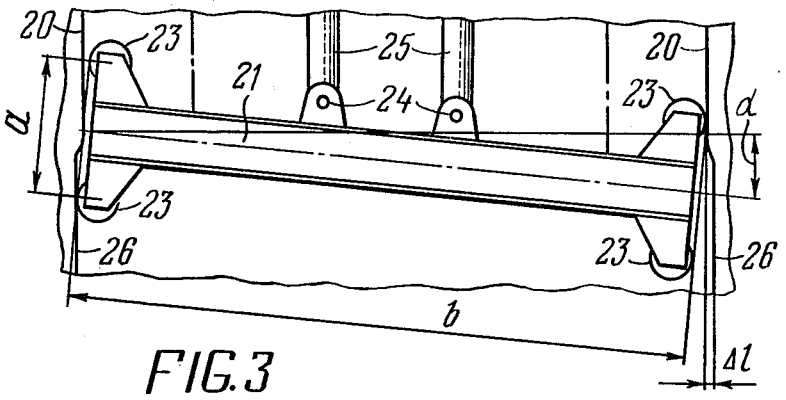
FIG. 3 is a view showing a part of the platform misalignment compensating device of the apparatus for electrohydroblasting of castings according to the invention.

As shown in FIG. 3, the magnitude $\Delta$ 1 of the clearance is $$\Delta 1 = a \sin \alpha - 2b \sin^2 \alpha/2,$$

where a is the distance between the extreme points of support of one end of the crosspiece, b is the distance between the ends of the crossbeam, and $\alpha$ is the permissible crossbeam turning angle which is not more than 10 degrees of arc.

Referring now to FIG. 4, the locators 18 of the uppermost position of the movable platform 7 have the form of stops each having a horizontal and an inclined contact flats 27 and 28 respectively. Compensating pads 29 attached to the horizontal flats 27 of the stops make it possible to compensate for errors in locating the platform 7, which errors may result from wear of the contact flats. The ends of the movable platform 7 carry slide blocks 30 by which the movable platform 7 bears against the vertical guides 8, the slide blocks 30 also being provided with horizontal and inclined contact flats 31 and 32 respectively corresponding to the respective contact flats 27 and 28 of the locators-stops 18 to enhance the accuracy of location of the platform 7 in the uppermost position.

Figure 5:
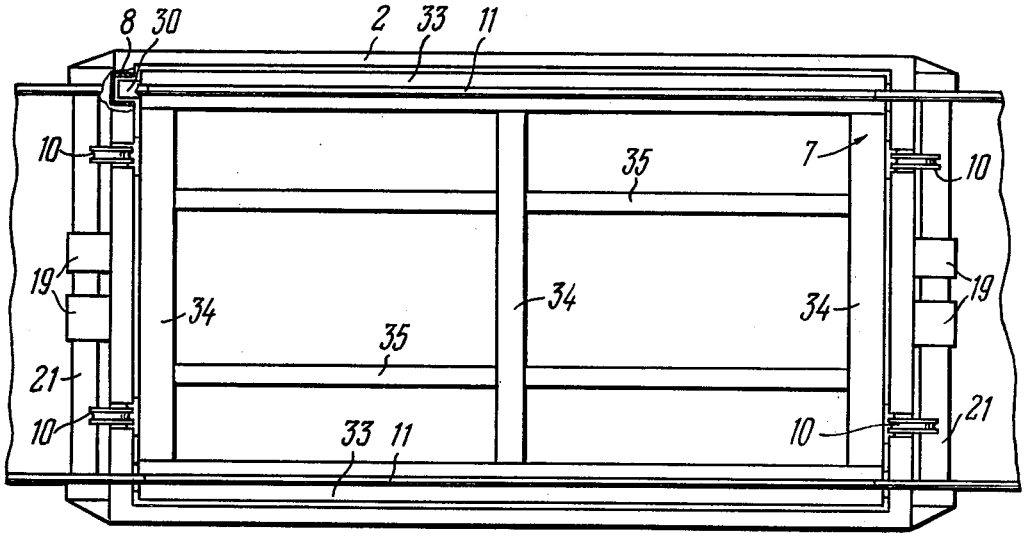
FIG. 5 is a plan view of the means for feeding castings into the bath of the apparatus according to the invention.

Referring now to FIGS. 4 and 5, the movable platform 7 is a frame having two bearing lengthwise girders 33 interconnected by cross girders 34 which are in their turn interconnected by lengthwise beams 35. The movable platform 7 is thus of a latticed construction, which allows the slurry resulting from the hydroblasting of castings to settle onto the bottom of the bath 2. Each of the bearing lengthwise girders 33 mounts one of the horizontal guides of the loading means.

Each of the horizontal guides 11 has, as shown in FIG. 6, the form of a rail.

Figure 7:
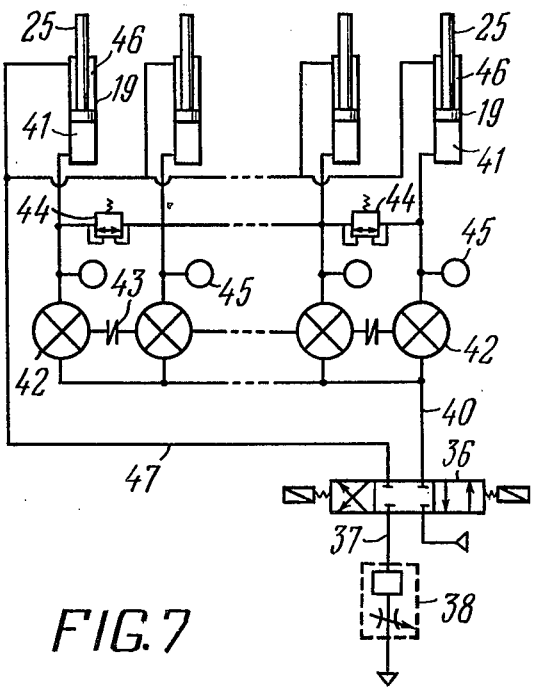
FIG. 7 is a block diagram of the hydraulic drive of the means for feeding castings into the bath of the apparatus according to the invention.

Now the construction of the drive of the means for feeding castings into the bath according to the invention will be considered in greater detail. Said drive has the form of a hydraulic system which comprises, as shown in FIG. 7, along with the above-mentioned hydraulic cylinders 19, an inlet line 36 and an outline line 37 incorporating an automatically adjustable throttle 38. The hydraulic cylinders 19 are connected to the lines through a hydraulic distributor 39 and a system for synchronizing the movement of the hydraulic cylinder rods. Said system for synchronizing the movement of the hydraulic cylinder rods comprises a branched pressure piping 40 which connects the hydraulic distributo 39 with the above piston chambers 41 of the hydraulic cylinders 19.

Each branch of the pressure piping 40 incorporates a hydraulic motor 42. The rotors of all hydraulic motors are fixedly interconnected by means of jaw couplings 43. Adjacent branches of the pressure piping 40 are interconnected through by-pass valves 44. In addition, pressure relays 45 electrically connected with the actuator of the hydraulic distributor 39 (the connection is not shown in the drawing) are provided in the sections of the pressure piping 40 between the hydraulic motors 42 and the hydraulic cylinders 19.

Rod chambers 46 of the hydraulic cylinders 19 are connected to the hydraulic distributor 39 by a branched piping 47.

Figure 8:
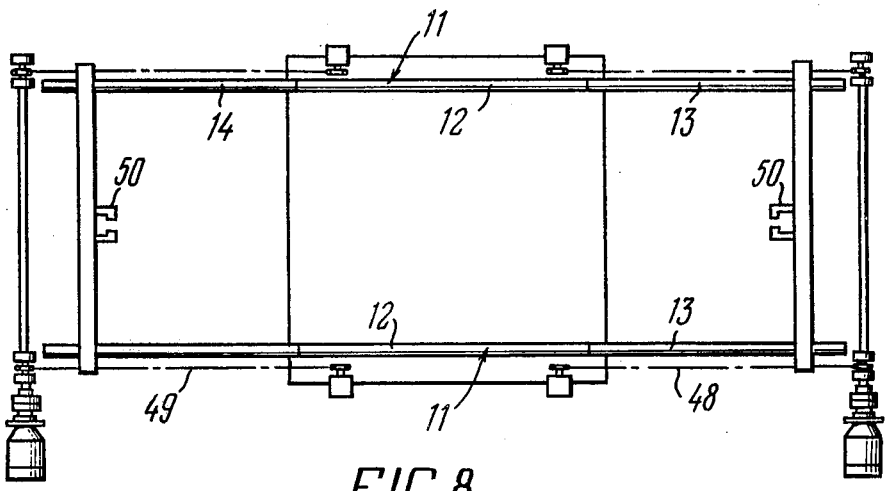
FIG. 8 is a plan view of a modification of the apparatus for electrohydroblasting of castings, according to the invention, with rectilinear horizontal guides in the loading device.

Referring now to FIG. 8 of the drawings which shows one of modifications of the loading device of the apparatus for electrohydroblasting of castings according to the invention, it will be seen that the sections 13 and 14 of the horizontal guides 11, mounted on the base, are rectilinear, and the means 15 for conveying castings along the horizontal guides is composed of chain conveyors 48 and 49 carrying grips 50 and disposed respectively on the sections 13 and 14 of the guides.

Figure 9:
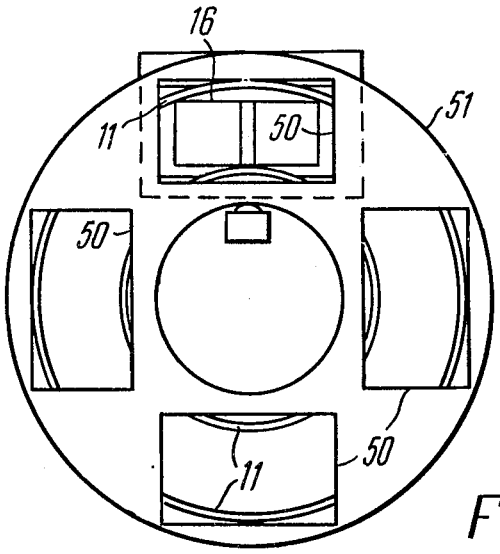
FIG. 9 is a plan view of a modification of the apparatus for electrohydroblasting of castings according to the invention with curvilinear horizontal guides in the loading device.

FIG. 9 shows an alternative modification of the loading device of the apparatus for electrohydroblasting of castings. According to the invention, the horizontal guides 11 of the loading device are in this modification curvilinear and ring-shaped in plan. The means 15 for conveying castings along said guides has the form of a rotor 51 having apertures corresponding in shape and size to the containers with castings. The walls defining said apertures serve as the grips 50.

Figure 10:
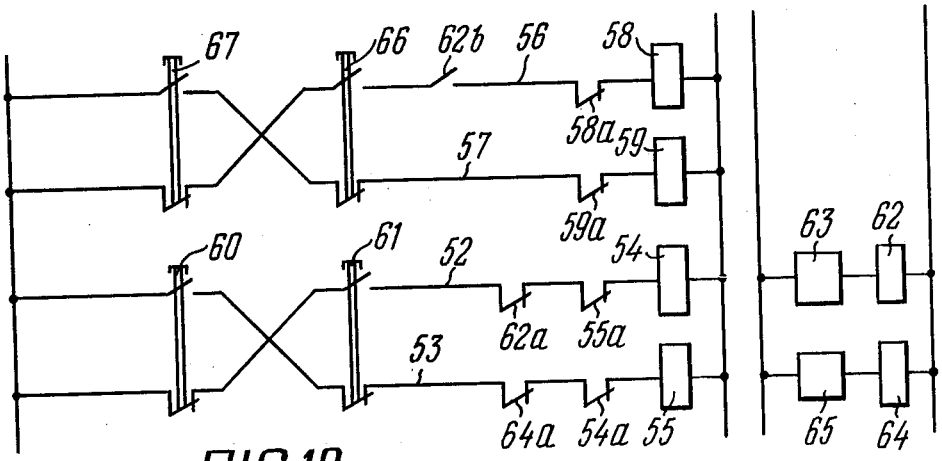
FIG. 10 is a schematic diagram of the control circuit of the means for feeding castings into the bath and for conveying castings along the horizontal guides in the apparatus according to the invention.
Figure 11:
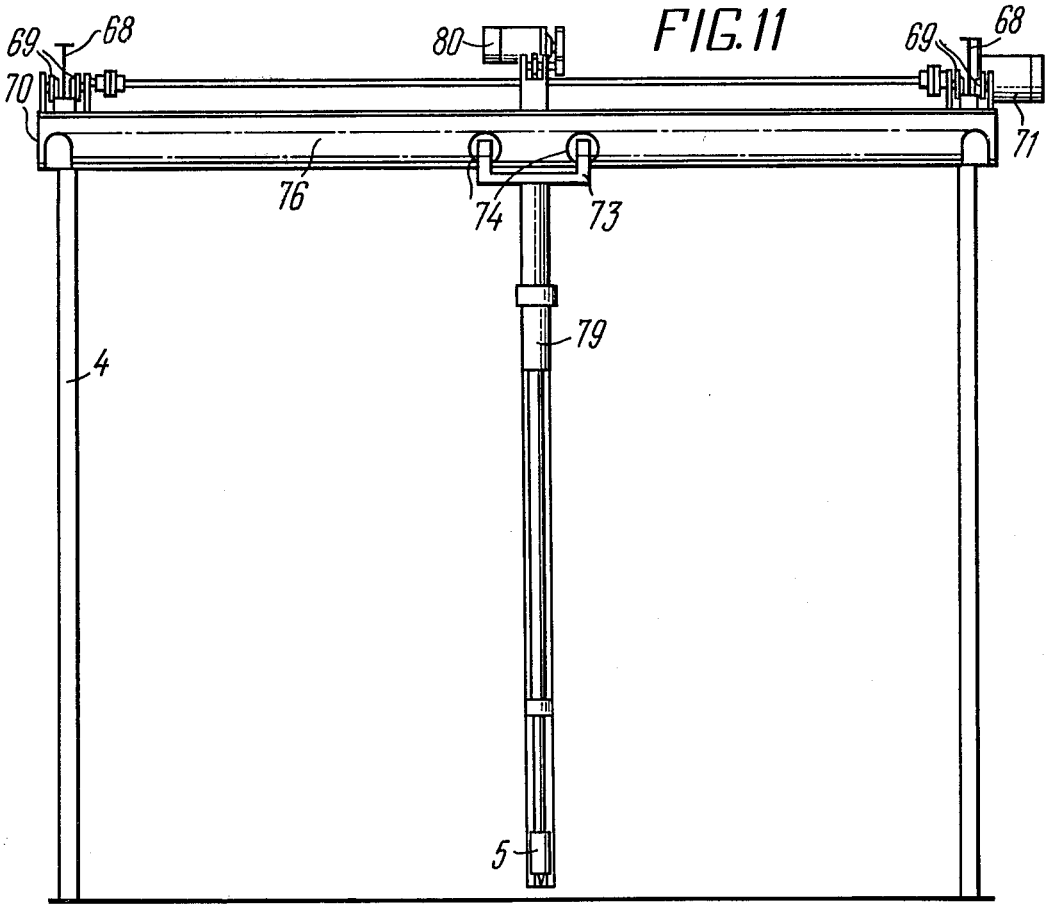
FIG. 11 is a view in the direction of arrow D in FIG. 1, illustrating the device for introducing an electrode into the bath of the apparatus for electrohydroblasting of castings according to the invention.
Figure 12:
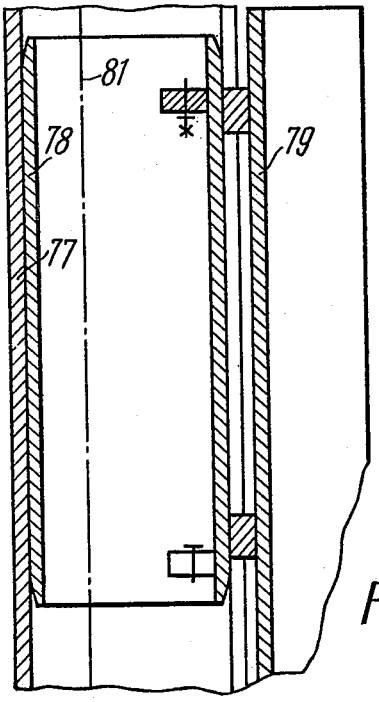
FIG. 12 is a sectional view taken along the lines XII—XII in FIG. 11.

Referring further to FIG. 10 of the drawings which represents the schematic diagram of the control circuit of the means for feeding castings into the bath and of the means for conveying castings along the horizontal guides, according to the invention, the control circuit of the means for feeding castings into the bath includes circuits 52 and 53 of electromagnetic relays 54 and 55 controlling operation of the hydraulic distributor 39. The control circuit of the means for conveying castings along the horizontal guides includes circuits 56 and 57 of electromagnetic relays 58 and 59 controlling the drive of the conveyor 48, as well as circuits of relays controlling the drive of the conveyor 49, said circuits (not shown) being identical to the circuits 56 and 57.

The circuits 52 and 53 incorporate a "DOWN" pushbutton 60 and an "UP" pushbutton 61, which pushbuttons are arranged on a control panel (not shown). The circuit 52 of the relay 54 incorporates contacts 55*a* of the relay 55, and the circuit 53 of the relay 55 incorporates contacts 54*a* of the relay 54. The circuit 52 of the relay 54 incorporates also contacts 62*a* of a relay 62 of a limit switch 63, and the circuit 53 of the relay 55 incorporates also contacts 64*a* of a relay 64 of a limit switch 65. The limit switches 63 and 65 are disposed in the path of the movable platform 7 (FIG. 2). The circuits 56 and 57 incorporate a "FORWARD" pushbutton 66 and a "REVERSE" pushbutton 67, which pushbuttons are arranged on the control panel (not shown). The circuit 56 of the relay 58 incorporates contacts 59*a* of the relay 59, and the circuit 57 of the relay 59 incorporates contacts 58*a* of the relay 58. In addition, the circit 56 of the relay 58 incorporates contacts 62*b* of the relay 62 of the limit switch 63. The means for feeding castings into the bath is thus by means of the relay 62 operationally interlocked while the means for conveying castings along the horizontal guides. When the means for conveyihg castings along the horizontal guides has the form of a rotor, contacts of the relay 62 of the limit switch 63 should be also incorporated in the circuit 57 of the relay 59.

Referring now to FIGS. 1, 11, 12, 13 of the drawings, which show in detail the device 6 for introducing the electrode into the bath of the apparatus for electrohydroblasting of castings according to the invention, the gantry 4 mounted above the bath 2 comprises two parallel l-beams 68 wherefrom a travelling bridge 70 of the device 6 for introducing the electrode into the bath is suspended by means of rollers 69. The drive of the travelling bridge 70, comprising a hydraulic motor 71 and a chain transmission 72, mounted on the gantry. The travelling bridge 70 carries a movable carriage 73 mounted on rollers 74; the carriage is provided with a drive for movement along the travelling bridge 70, comprising a hydraulic motor 75 and a chain transmission 76, and accommodates a means for vertical movement of the electrode, comprising a vertical guide in the form of a split tube 77. The split tube houses a slide block 78 to which an electrode holder 79 is attached. The electrode 5 is secured in the electrode holder. The means for the vertical movement further comprises a drive coupled with the slide block 78 and including a hydraulic motor 80 and a chain transmission 81.

Figure 14:
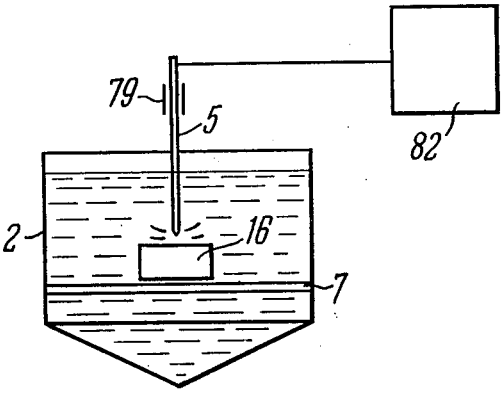
FIG. 14 is a functional diagram of the electrode control circuit.
Figure 13:
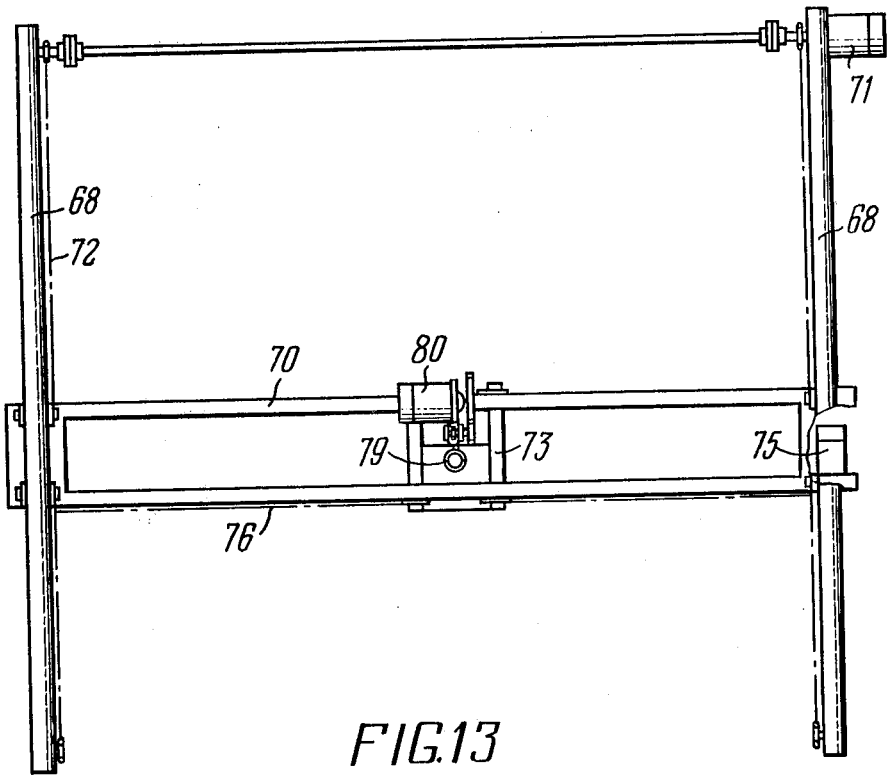
FIG. 13 is a plan view of the device for introducing an electrode into the bath of the apparatus for electrohydroblasting of castings according to the invention.

The apparatus for electrohydroblasting of castings comprises also a pulse-current generator 82 electrically connected with the electrode 5 (FIG. 14).

The above-described apparatus for electrohydroblasting of castings functions as follows.

With the apparatus for electrohydroblasting of castings in starting position (FIG. 1), the movable platform 7 is set to the uppermost position so that the horizontal guides 11 of the section 12 mounted on the movable platform 7 are brought into abutting relation with the horizontal guides 11 of the sections 13 and 14 disposed on the base 1, as ensured by a tight pressure of the platform 7 against the stops 18 (FIG. 4). An accurate location of the platform 7 with respect to the stops 18 is attained by aligning the contact flats 37 and 38 on the slide blocks 30 of the platform 7 with the contact flats 27 and 28 of the stops 18.

With the platform 7 in said position, one of the crossbeams 21 mechanically acts upon the limit switch 63 (FIG. 2) to cause the contacts (FIG. 10) of the relay 62 of the control circuit 56 of the means for conveying castings along the horizontal guides to close.

The container 16 with castings is, with the aid of inshop hoisting means (not shown), placed onto the section 13 of the horizontal guides 11 so that a coupling device provided on a wall of the container 16 engages the grip 50 of the means 15 for conveying castings along the horizontal guides 11.

The operator with the aid of the "FORWARD" pushbutton 66 (FIG. 10) completes the control circuit 56 of the drive of the conveyor 48 (FIGS. 1, 8). The conveyor 48 by means of one of the grips 50 acts upon the container 16 to move the latter along the guides 11 to the section 12. When the container 16 is completely arranged on the section 12, the operator actuates the "DOWN" pushbutton 60 (FIG. 10) to complete the circuit 53 of the relay 55 controlling the operation of the hydraulic distributor 39 (FIG. 7). The hydraulic distributor 39 operates to connect the pressure piping 40 with the outlet line 37 and the piping 47 with the inlet line 36. A liquid under pressure is admitted from the inlet line 36 via the piping 47 into the rod chambers 46 of the hydraulic cylinders 19. Under the action of said liquid and the weights of the platform 7 (FIG. 1) and of the container 16, which action is transmitted to the rods 25 of the hydraulic cylinders 19 through the flexible pull members 9 and the crossbeams 21 (FIGS. 2, 3), the liquid is forced out of the above-piston chambers 41 (FIG. 7) into the branched piping 40 whose branches incorporate the hydraulic motors 42. The platform 7 (FIG. 1) with the container 16 descends into the bath. Being fixedly interconnected, the rotors of the hydraulic motors 42 (FIG. 7) rotate at the same speed, thereby ensuring equal deliveries of liquid out of the above-piston chambers 41 of the hydraulic cylinders 19 and hence a uniform descent of all sides of the platform 7 (FIG. 1). The speed of descent of the platform 7 is adjusted with the aid of the automatically regulated throttle (FIG. 9) which stabilizes the overall flow rate of the liquid, which is forced out of the above-piston chambers 41 of the hydraulic cylinders 19 through the outlet line 37.

As the platform 7 (FIG. 1) descends into the bath, the crossbeam 21 ceases to act upon the limit switch 63 (FIG. 2). The relay 62 (FIG. 10) operates to open its contacts 62*b* and thus to break the circuit 56. This blocks the means 15 for conveying castings along the horizontal guides to prevent feeding castings to processing means as long as the guides 11 (FIG. 1) of the section 12 and the guides of the sections 13 and 14 remain out of abutment.

The platform comes to a stop when the crossbeam 21 acts upon the limit switch 65 (FIG. 2) of the platform lowermost position. The relay 64 (FIG. 10) operates to open its contacts 64a and thus to break the circuit 53 controlling operation of the hydraulic distributor 39 (FIG. 7), thereby cutting off the hydraulic drive.

When the platform 7 (FIG. 1) is in its lowermost position, the container 16 with a casting (castings) is fully immersed into the bath with a working liquid. The operator brings the electrode 5 to the immersed container 16 with a casting (or castings), manipulating the electrode with the aid of the device 6 (FIGS. 1, 11, 12, 13) for introducing the electrode into the bath. The electrode 5 is first moved in the horizontal plane and positioned above a characteristic point of the casting by means of the travelling bridge 70 and the carriage 73, and then, as the operator actuates from the control panel the hydraulic motor 80, is brought near the castings. The hydraulic motor 80 acts through the chain transmission 81 upon the slide block 78 which, travelling along the split tube 77, moves the electrode holder 79 with the electrode 5, attached to the slide block. The action of the pulse electric discharges arising between the electrode 5 and the casting breaks down in the known manner the layers of core and moulding sands sintered on the surfaces of the casting. When the casting is of a complex shape, the operator moves the elecrode 5 against each characteristic point of the casting, according to a diagram given to him, to ensure a complete cleaning.

Having completed the cleaning and withdrawn the electrode 5 to the initial position, the operator depresses the "UP" pushbutton 61 (FIG. 10) to complete the circuit 52 of the relay 54 controlling the hydraulic distributor 39 (FIG. 7). The hydraulic distributor 39 operates to connect the pressure piping 40 with the inlet line 36 and the piping 47 with the outlet line 37. The liquid under pressure from the inlet line 36 is admitted via the piping 40 into the above-piston chambers 41 of the hydraulic cylinders 19, causing the latter to operate. The hydraulic cylinders 19 through the flexible pull members 9 (FIG. 2) move the platform 7 (FIG. 1) upwards. A smooth and uniform ascent of the platform 7 is ensured by a synchronous movement of the rods 25 of the hydraulic cylinders 19, which synchronous movement results from the equality of the amounts of the liquid admitted into the chambers 41 (FIG. 7) of the hydraulic cylinders 19. This quantitative equality of the flows into the chambers 41 of the hydraulic cylinders 19 results from the same rotational speed of the fixedly interconnected rotors of the hydraulic motors 42, which balance the flows of the liquid in the branches of the piping 40. In some instances, however, the platform 7 (FIG. 1) may get misaligned in the course of its movement, with the results that when it comes to its uppermost position, one (some) of its sides will stop short of the stops 18, whereas another (other) side will tend to travel past the corresponding stops 18. In such an instance, an excess pressure will develop in the above-piston chambers 41 (FIG. 7) of the hydraulic cylinders 19 coupled with those sides of the platform 7 (FIG. 1) which have reached the uppermost position. The action of said excess pressure will cause the corresponding by-pass valves 44 (FIG. 7) to operate and admit the liquid from the chambers with the excess pressure into the chambers of the hydraulic cylinders 19 coupled with the unlocked side of the platform (FIG. 1). This makes possible a further operation of the hydraulic motors 42 (FIG. 7) which force fluid in the chambers of those hydraulic cylinders 19 which "lag behind," thereby leading to an accelerated motion of their rods and to levelling of the platform 7.

The platform may be misaligned in its uppermost position due to a nonuniform stretching of the flexible pull members; the platform misalignment compensators will then operate in the following way. The crossbeams 21 which are hinge-connected to the rods 25 (FIGS. 2, 3) and to which the flexible pull members 9 are attached in pairs effect a plane-parallel motion in the twin guides 20 to tension the flexible pull members 9. As the platform 7 reaches the uppermost position (FIG. 3), the shorter pull member 9 of the pair will prevent a further movement of that end of the crossbeam 21 to which it is attached. Then the action of the rods 25 (FIG. 2) of the hydraulic cylinders 19, to which rods the crossbeam 21 is hinge-connected, will cause the crossbeam 21 to turn, the centre of the turn being the point of attachment of the shorter pull member 9 (FIG. 3) to the crossbeam 21, and to tighten the longer pull member 9. The turning of the cross beam in the twin guides is made possible by the provision of clearance between the ends of the twin crossbeams 21 and the bottoms 26 of the recesses provided in the twin guides 20. The uniform tightening of all the pull members 9 ensures a tight pressing of the platform 7 against the locators-stops 18 and hence an accurate abutment between the sections 12, 13, 14 of the guides 11.

In the position corresponding to the uppermost position of the platform 7 (FIG. 1), one of the crossbeams 21 (FIG. 2) comes into contact with the limit switch 63. The relay 62 (FIG. 10) operates to close its contacts 62b, which unblocks the means 15 for conveying castings along the horizontal guides. The operator starts the conveyors 48 and 49 (FIG. 8) disposed on the sections 13 and 14 of the horizontal guides 11. The conveyor 49 grips the container with the cleaned castings and conveys it to the unloading station. At the same time, the conveyor 48 conveys the next container with the castings to be processed from the loading station whereon it was placed while the preceding castings were being processed.

Then the cycle is repeated.

It will be understood that while the invention has been described herein in terms of a particular embodiment thereof, various other modifications of the apparatus for electrohydroblasting of castings in accordance with the present invention may be made without departing from the scope of the claims below.

What is claimed is:

1. An apparatus for electrohydroblasting of castings, comprising:

a base;

a bath mounted on said base;

means for feeding castings into the bath, comprising:

a movable platform mounted in vertical guides installed on the sides of said bath;

a drive disposed adjacent said bath;

flexible pull members through which said drive is coupled with said movable platform;

platform misalignment compensators through which said flexible pull members are connected with said drive;

a loading device comprising:

horizontal guides for conveying castings therealong, having;

a section mounted on said movable platform of said means for feeding castings into the bath;

sections mounted on the base on both sides of the bath;

a means for conveying castings along horizontal guides which is operationally interlocked with said means for feeding castings into the bath;

an electrode set above the bath;

a device for introducing said electrode into the bath, mounted adjacent said bath;

a pulse-current generator electrically connected with said electrode.

2. An apparatus for electrohydroblasting of castings in accordance with claim 1, wherein said means for feeding castings into the bath comprises locators of the uppermost position of said movable platform, which locators are installed on the vertical guides wherein said movable platform is mounted.

3. An apparatus for electrohydroblasting of castings in accordance with claim 2, wherein said locators of the uppermost position of said movable platform are made in the form of stops each having a horizontal and an inclined contact flat, said movable platform having horizontal and inclined contact flats corresponding to the contact flats of said stops.

4. An apparatus for electrohydroblasting of castings in accordance with claim 3, wherein said stops comprise compensating pads attached to the horizontal contact flats of said stops.

5. An apparatus for electrohydroblasting of castings in accordance with claim 1, wherein said platform misalignment compensators comprise:

crossbeams whose ends are coupled with said flexible pull members, said crossbeams being coupled with said drive of said means for feeding castings into the bath by means of members which allow the crossbeams to swing;

twin guides wherein said crossbeams are mounted, said twin guides having recesses disposed on the sections corresponding to the extreme position of said crossbeams in lifting said movable platform to form a clearance between the ends of said crossbeams and said twin guides.

6. An apparatus for electrohydroblasting of castings in accordance with claim 5, wherein the magnitude $\Delta 1$ of the clearance between the ends of said crossbeams and said twin guides is equal to:

$$\Delta 1 = a \sin \alpha - 2b \sin^2(\alpha/2),$$

wherein a is the distance between the extreme points of support of one end of the crossbeam, b is the distance between the ends of said crossbeams, and $\alpha$ is the permissible turning angle of said crossbeam, which is not more than 10 degrees of arc.

7. An apparatus for electrohydroblasting of castings in accordance with claim 1, wherein said drive of said means for feeding castings into the bath comprises:

a group of hydraulic cylinders having rods, the rods of said hydraulic cylinders being hinge-connected with said crossbeams of said platform misalignment compensators;

a system for synchronizing the movement of the rods of the hydraulic cylinders which comprises:

hydraulic motors through which a liquid is fed to the chambers of said hydraulic cylinders, said hydraulic cylinders having rotors being fixedly interconnected;

by-pass valves interconnecting the chambers of said hydraulic cylinders, which communicate with said hydraulic motors.

8. An apparatus for electrohydroblasting of castings in accordance with claim 1, wherein the sections of said horizontal guides, disposed on the base, are rectilinear, and wherein said means for conveying castings along the horizontal guides comprises:

chain conveyors with grips, which conveyors are disposed on each of said sections of the horizontal guides.

9. An apparatus for electrohydroblasting of castings in accordance with claim 1, wherein said horizontal guides of said loading device are curvilinear and ring-shaped in plan and said means for conveying castings along the horizontal guides has the form of a rotor with grips.

* * * * *